US005628714A

United States Patent [19]

Philipson

[11] Patent Number: 5,628,714

[45] Date of Patent: May 13, 1997

[54] TWIN CUFF WEIGHT TRAINING APPARATUS

[76] Inventor: Alan S. Philipson, 8355 SW. 89th St., Miami, Fla. 33156

[21] Appl. No.: 452,266

[22] Filed: May 26, 1995

[51] Int. Cl.[6] ..... A63B 23/035

[52] U.S. Cl. ..... 482/92; 482/102; 482/139

[58] Field of Search ..... 482/93, 101–103, 482/105, 124, 131, 138, 139, 144, 148, 55, 125, 129, 130; 601/33–35, 27; 128/878, 882, 876; 70/16; 602/24

[56] References Cited

U.S. PATENT DOCUMENTS

| | | | |
|---|---|---|---|
| 4,747,779 | 5/1988 | Gerstung | 128/882 X |
| 4,911,434 | 3/1990 | Herring | 482/139 X |
| 4,949,957 | 8/1990 | Cucchiara | 482/139 X |
| 5,169,364 | 12/1992 | Donaldson | 482/139 X |

FOREIGN PATENT DOCUMENTS

| | | | |
|---|---|---|---|
| 334255 | 9/1930 | United Kingdom | 482/131 |

OTHER PUBLICATIONS

Body Solid Tricep Strap (#NTS–10) ©1993 catalog pp. 23–24.

*Primary Examiner*—Richard J. Apley
*Assistant Examiner*—John Mulcahy

[57] ABSTRACT

The present invention is applicable to the field of weight training. The device described herein comprises of insulated twin manacles that would be placed upon the users ankles and attached to a weighted cable. The user has a wide array of exercises to choose from at this point including hamstrings, abdominal, quadreccepts, etc. The rise of weight to achieve an isotonic contraction has long been recognized to promote proximal musculature in a desired anatomical region. A twin manacle design allows the user to engage both appendages simultaneously allowing for a balance to exist between both limbs. This directly attacks the "dominant/subservient" theory that we can define as one limb or appendage having the ability to over compensate for its weaker counter part.

6 Claims, 5 Drawing Sheets

TWIN CUFF WEIGHT TRAINING APPARATUS

BACKGROUND OF THE INVENTION

1. Field of the Invention

The invention described and claimed herein is generally related to equipment and procedures used in weight training and muscle toning. More particularly, the present invention is related to devices which are worn by the individual for the purpose of enhancing the effectiveness of weight training exercises.

2. Description of Related Art

It is well known among exercise physiologists and has been documented in numerous medical, as well as athletic journals, that the most effective means of creating definition and muscle mass is through the process of isolation. This process was partially addressed in U.S. Pat. No. 4,949,957 (Cucchiara) issued on Aug. 21, 1990. The present invention differs from the prior art in a number of areas. First, the use of twin cylindrical tubes rather than a single tubular design affords the user the ability to exercise both appendages at the same time. This gives the subject a more stable anatomical balance. Believed to promote stability, the scientific community has long focused on decreasing the role of the dominant limb. The dominant/subservient limb theory subscribes to the belief that just as one eye is more optically correct and therefore dominant, the same applies to all facets of anatomical make. This would imply that by pulling an equally distributed amount of weight, at separate trajectories, the weight would shift to the limb capable of contracting at a greater rate (the dominant limb). While the instant device is similar in respect to the cylindrical shape as Cucchiara, there are significant differences. Engineered and implemented as a tool to efficiently and effectively exercise the lower appendages including (but not limited to), the lower anterior and posterior muscle groups. The instant device is effective in increasing proximal musculature and anatomical balance.

In the development of the abdominal region, the instant device would be fitted to the subjects' ankles (FIG. 3), and attached to the tensile cables. Upon choosing the desired weighted resistance, the subject would lie flat or at an incline depending upon the portion of abdominal anatomy the subject wished affected. Positioning him/herself upon a raised flat surface, with his/her legs in a slightly bent position, the test subject would slowly allow the legs to fall at a controlled speed. While doing so, the subject will make the abdominal cavity contract accordingly. The controlled speed and movement would give the user both a positive and negative resistance, thus stimulating an increased contraction in the desired primary muscle groups.

The twin-cuffs-secured design enables the wearer to be focused on the task of exercising, rather than that of balancing shifting appendages. Not unlike that of seismic activity when two tectonic plates rub along side one another, the jarring, or uneven shifting is caused by the apparatuses slipping back and forth during contraction. When exercised interdependent of each other and attached to an external weight, shifting of the two cuffs causes an uneven contraction. This contraction causes the cuffs to travel at separate and different speeds resulting in a rough or "bumpy" ascent and decent. Adding to the forementioned complications is the necessity of "balancing" the legs during the exercise, which distracts from the original intentions of the exercise. In order to facilitate the above abdominal exercise with the Cucchiara device, two cuffs must be available, and in some way permanently attached or balanced. The test subject would then begin by attaching the devices to the ankles, applying tension to the lower loops located on the bottom of the bodies of the design. Recreating an identical movement to that of the instant device, the subject would attempt to the repeat the above movements. By having to balance the shifting limbs, the use of the sartorius muscles must be incorporated in order to control the uneven contraction. This uneven contraction is due primarily to the two rings continuously shifting in the clamp during the course of the exercise. While this seems to be a problem easily corrected by fastening two clamps to steady the shifting apparatuses, the nonrigid connection still allowed the limbs to move independently with the dominant limb leading the movement and carrying the subservient limb. Further, the prior art has been shown to substantially favor the upper torso while attending briefly to the abdominal cavity and the surrounding muscles including, and not limited to, the serratus, and the oblique.

In order to isolate and successfully contract the lower abdominal or "rectus abdominal" the subject would utilize the traditional method of grasping a weighted dumbbell between the feet. With this in mind the subject must begin pulling the dumbbell in an upright, controlled fashion. The movement which would be considered isotonic in nature (moving a certain amount of weight at a controlled speed), is only partially effective due to the unusual amount of stress being placed upon the synergist or lower lumbar. The pressure exerted upon the lower lumbar turns this exercise into an arduous and painful endeavor. The lower back is not the only portion of the anatomy which will be made to suffer; The need to balance the weight upon the anterior, or upper portion of the foot to accomplish the task of adding resistance places pressure on the skin causing the weight to be transferred, thereby pressing the skin against the smaller and more fragile metatarsal (bones). This can cause other problems in individuals suffering from Tarsal Tunnel Syndrome. This is when the small bones in the foot or the "tarsals" are moved causing peroneal nerve entrapment. This causes anterior cansias inflammation at the retinaculum and pain between the lateral and median malleoli. In layman's terms, this inflammation causes the subject to experience both pain and muscle dormancy in the foot and ankle area. This condition similar to "carpal tunnel syndrome" of the hands renders the subject unable to experience "flexion" in the foot, thus encumbering the subject's ability to grasp and perform with a dumbbell or weighted object. FIG. 3 shows completing the identical task as above, instead of using the cumbersome and potentially dangerous dumbbell, the subject will be able to utilize the tensile cables offering a smoother and balanced workout. Besides the obvious physical repercussions described above, the need to use secondary or flexor muscles, in this case the tibialis anterior (which controls the upward flexion of the foot), is not necessary to balance and contain the awkward and shifting dumbbell.

Accordingly, the effectiveness of the prior art and other conventional isotonic exercises is limited to the abilities of the secondary or flexor muscle groups. Which is to say, the primary or desired muscle being stronger, will require a greater amount of resistance than the smaller counter part can provide. An overload or the ability to reach anaerobic exhaustion without first tiring the flexor group limits the scope of the prior art as well as all exercise which require flexion or "grasping". A common example of this is raking the lawn. The hands which represent the flexor group will exhaust their means way before the biceps or shoulders become tired. This is a signature of such debilitating physical challenges as carpal tunnel syndrome in which the subject feels great streaks of pain radiating up the arm. Without eliminating that need to use the secondary muscle group, the primary group would not be able to exert the total amount of force necessary to create an "overload". According to the American College of Sports Medicine, the only way to increase size of a particular muscle group is "to exert a constant and specific force on said group greater than that which is usually applied in any given situation, thus causing an overload".

The instant device was tested with a test subject completing the identical task of leg raises as above under the close scrutiny of the head of the Physical Therapy Department at the Florida International University. Test and control groups were formed to assist in the validity as well as the objectivity of this test. In the test group, the instant device was attached to the subjects ankles, then attached to the pulley system of the weight stack. The larger, or gross numbers represent the findings of the control group. The control group consisted of the same subject using a 20 pound dumbbell. The subject followed the same procedure as with the instant device, however the results came out entirely different. To determine with accuracy the amount of effort exerted during a contraction, the subject was connected to a Elector Myogram Or (EMG). The purpose of the EMG is to measure the elector-stimuli within the muscle tissue, and determine whether or not a muscle has increased or decreased in activity. The sensors were attached to the anterior portion of the upper quadriceps muscles (Q), and the abdominal (ABD) musculature (left rectus abdominous), as well as the biceps femoris (hamstrings), and its respective secondary or stabilizer the gastrocnemius (calves). When tested, the instant device provided the following results: muscular stimulation and contraction in the abdominal region increased from 83.43 to 88.88. While this indicates a good increase in isotonic muscular contraction, the largest gain occurred within the quadracept muscle (Q) (secondary musculature). The need for flexor activity in the anterior quadricep was reduced almost six hundred percent, from 37.92 to 6.29. The EMG receptors were then attached to the subjects' biceps femoris (hamstring), as well as the gastrocnemius, medial head (calves). The subject was made to contract under two conditions with and without the use of the instant device. The device was attached to the ankles of the subject and connected to the weighted tensile cable. During the course of the contractions, the following millivolts were extracted. The biceps femoris (desired primary muscle group), increased from 13.19 without the device, to 47.23 with the use of the instant design. While increasing contraction of the large primary muscle groups by over 350%, the unwanted flexor or secondary muscle group was decreased almost 400%, from 28.36 without the device to 7.36 millivolts with the device.

The presence of a rigidly connected second cuff stabilized the appendages and caused a tangible equilibrium to exist between the two working limbs. The need to balance the shifting cuffs was removed from the equation, and the secondary muscle decreased in activity accordingly. Further, to support the theory on dominance, the test subject used was right leg dominant and during contraction without the instant device the right leg was guiding the left leg at a disproportionate rate. The subject then attempted identical movements with the device, wherein the millivolts declined substantially, and the limbs appeared to contract in a more uniform manner.

The hamstrings and quadriceps are another group of diverse muscles which rely on a number of different compulsive exercises to cause an overload. The hamstrings and quadriceps consist of, but are not limited to: the gracilis, adductor Magnus, semimembranosus, semitendinosus, biceps femoris, vastus lateralis, sartorius, gluteus maximus, and quadratus femoris. One of the ways to exercise the hamstring group is through the use of the hamstring curl or reverse leg curl machine. With this machine, the subject lies face down, placing his/her feet under a round pad, and with the posterior portion of the ankles, the subject pulls the weight in an upward motion. The weight is transferred from the weight stack through a series of pulleys to the hamstring muscle group. The desired overload is frequently met, however, the pressure is often transferred to the lower lumbar region of the back through the arch needed to facilitate the rapid contraction necessary to accelerate the momentum of the weight. Even though, the subject is lying face-down, the back needs to arch to accommodate the flexor muscles such as the gastrocnemius or calve muscles, which when contracted, cause the lower back to constrict.

Unlike the conventional reverse curl machine, the instant device causes an overload through isotonic annexation. By attaching the device to the subjects ankles, the subject is able to contract the posterior hamstring (flexor biceps) without utilizing the feet or the calves (Gastrocs). Another method which is common in fitness environments is the reverse hamstring biceps curl. The subject in this case lies face down on a bench and a dumbbell is placed upon the posterior or bottom portion of the feet. The dumbbell must be balanced, and close attention must be kept by an individual assisting in the exercise. In order to correctly facilitate this exercise, there must be two active participants, the individual exercising, and a "spotter" who overseas the activities of the individual exerciser. Much like the forementioned reverse curl machine, conventional weights in this exercise pose an inherent degree of danger to the user. To facilitate the inertia to move the dumbbell, the legs must contract in a powerful movement thus shifting the body. The weight will continue to travel in an upward direction until opposing forces bring it to a halt. If the subject is unable to balance the shifting weight between his feet, the weight could fall on the subject causing a severe impact and injury to the spine, neck, or head. As with aforementioned reverse curl machine, the subject applies the device to the ankles, and lying facedown on a bench, begins contracting and extending the appendages. The subject can decide to either use the upper or lower portion of the hamstring group by lowering or raising the bench. This is a benefit not available in reverse curl machines and is too difficult to attempt with a dumbbell. Further, as the tests conducted at Florida International University demonstrated, the secondary or flexor group in this case, the calves (Gastrocs), must be utilized to control the weight. The dumbbell which is "seated" upon the bottom of the feet requires the gastrocs to stabilize and maintain a flat surface so the weight does not fall.

The prior art was primarily designed to facilitate proximal musculature in a single appendage, and was not designed to utilize both limbs simultaneously. This is obvious in FIG. 1 of Cucchiara, in which a single cuff is demonstrated. Had this design been intended to work both appendages simultaneously, provisions for an additional cuff would appear, and the body of the patent would describe the cuffs in a plural manner. Further, had the ability to simultaneously exercise both appendages been addressed, the aforementioned device would have interlocking capabilities, i.e. the ability to become permanently fixated to one another.

The instant device is versatile and diverse in design and can be used in an environment other than a gym. By using the device without added weight, the subject can choose from a number of exercises including the aforementioned leg-lifts, abdominal crunches, and hamstring curls. Utilizing positive and negative forces, the device can provide an increase in proximal abdominal musculature by allowing the subject (during exercise), to concentrate on controlling the movement rather than focusing on balancing and holding two appendages together. The device may be supplied with an elastic or "weighted" rubber band which would be connected to a permanently affixed item in the home, such as a door. The individual would attach the weighted band with a clamp to the bottom of a secured, closed door. The band would then be connected to the device by a clip located at the end of the band with the twin cylindrical tubes (FIG. 1, item 6). The individual can now complete the identical tasks just as if they were in a professional fitness environment with similar results and intensity. This aspect would appeal to most individuals since it is reported that two-thirds of the American population are not members of a gym or formal exercise facility. Further, the device can be used in an aerobic setting. Aerobics is defined by The American College Dictionary as "pertaining to or caused by the presence of oxygen". By increasing the individuals heart rate and metabolic activity, oxygen level is increased thus oxygenating the cells. By using a rhythmic and continuous movement, the subject can increase, oxygenation and heart rate just as in any other aerobic exercise such as running or swimming. Following the same guidelines as with the weighted exercises, and increasing them to become rhythmic and compulsatory movements, the device can be adaptable to a large aerobic setting to enhance both muscle tone as well as cardiovascular endurance. The prior art can only be used to facilitate an anaerobic workout. Therefore, prior art is limited to (1) the presence of weight or tensile cables, (2) only anaerobic exercise, and (3) the ability to work only a single limb at a time. Unable to use both limbs simultaneously, as well a making no accommodations to join two devices together, Cucchiara can not effectively be used to increase the cardiovascular or metabolic rate, therefore, it can only be utilized anerobicly.

The instant device has a number of medical applications as well. These applications have been tested on a number of physiological problems. One such problem is arthritis. Unable to complete the agonizing task of grasping weights to facilitate exercises depicted in the above passages, the device provides the ability to exercise without the considerable pain and discomfort. The use of both limbs successfully and simultaneously reduce the arthritic swelling thus, subsiding the eminent pain. With the implementation of the device, pain although not eliminated, usually subsides substantially. This is important as it indicates an increase in protective muscle tissue surrounding the joint, allowing the joint to be relieved of any grinding pressure. Further, a modified device may be used in the rehabilitation and restoration to a group of badly damaged limbs. The extensive damage, such as from a gunshot, may make movement quite impossible, and exercise a nonrealistic goal.

Accordingly, it is the purpose of the instant design to be attached to limbs at any point, and act as an artificial "prosthetic". By reducing the need for secondary muscular stimulation, the primary muscle group can be made to perform to the point of exhaustion., and can be placed under a greater amount of tensile load for a greater duration of time. Further, it is the objective of the instant device to provide a weight training apparatus which effectively isolates the proximal musculature of the entire abdominal cavities, as well as the lower appendages.

SUMMARY OF THE INVENTION

The present invention provides an isolation leverage weight training cuffs for exercising large and primary muscle groups to the point of exhaustion. This design is primarily used for the lower torso including, but not limited to, the rectus abdominal, obloquies, and the serratus, the quadricep group and the hamstring muscle group which includes, but is not limited to, the gracilis, adductor Magnus, semimembranosus, semitendinosus, biceps femoris, vastus lateralis, sartorius, gluteus maximus, and quadratus femoris muscles. The cuffs are comprised of tapered flexible cylindrical tubes which can be attached to or about the calve area of the lower leg, or about the wrist or forearm of the arm. The cuffs are made of material resilient enough to be placed under a varying degree of weight and neither crack nor bend. When attached to the legs, the device's primary goal is to exercise both the anterior and posterior muscle groups. The instant device allows both appendages to receive a constant and equally distributed amount of tensile load, correcting the sometimes dominant limb from counter balancing or overcompensating for the weaker limb.

The device is fixated to the desired appendages through a series of fasteners such as rachet bindings (7,8),or any number of fastening devices. The rachet latch (9,10) allows the device to be attached to the desired appendage (FIG. 3) without cumbersome buckles and straps found in some of the prior isolation devices. This not only enables a simpler and less complex means of attachment, but also adds uncompromised security and safety. At the point of exhaustion, a muscle goes from a voluntary to an involuntary state in which the individual does not have the degree of control as when the muscle was fresh. No matter how exhausted, the device will securely hold the weight until it can be carefully removed. When uncontrollable physiological problems exist, such as epilepsy, seizures come with little or no warning, and with varying degrees of seriousness. The fasteners (9,10) in an emergency situation, can be removed in a matter of seconds allowing the individual to receive appropriate medical attention.

The means of fastening the device to external weighted resistance is centered between the two cylindrical tubes (6). A fastener constructed of pliable nylon is able to move either verticly, or horizontally, (5) allowing a wider array of angles and movements which utilize each muscle to exhaustion. The device can also be attached to, but is not limited to, conventional free weights (FIG. 3), or other available weight training devices including, but not limited to those expressed elsewhere in this application. The device can be used in a rehabilitative as well as a prescribed modified exercise environment.

Accordingly, an isolated rather than a gross movement will better enable the user to reach maximum effort in the larger important muscle groups without the implementation of smaller, inconsequential, flexor or extensor muscles. This aspect is especially important to those who are physically challenged with such afflictions as rheumatoid arthritis. Most weight movements require the ability to grasp or "hold" which may be a serious problem. The use of weight or "weighted" exercise has been shown to increase distal musculature response, growth, elasticity and resilience. These aspects are essential to the cushioning and reinforcing of vulnerable joints. Aside from increasing dense muscle tissue surrounding succeptable joints, the device is a viable rehabilitative and exercise component capable of fulfilling a wide number of physiological uses. The device can assist in recovering from the minute (broken bone), to physical traumas which have a significant and profound effect on the subjects abilities to operate or exhibit voluntary motor coordination (gunshot).

The device allows the choice of functions including weighted resistance and aerobic applications. By placing direct weight upon the desired muscle group, the user will be able to reach a period of muscle exhaustion at an accelerated and more comfortable pace. Further, there are many variations which are envisioned including leg lifts (FIG. 3) and hamstring curls (FIG. 6). Increasing pressure directly upon the rectus abdominal while reducing direct pressure on the lower back, raised leg-lifts have become an accepted replacement for the traditional bent-knee sit-up. By increasing strength and resilience of the abdominal musculature, the synergistic paravertebral muscles are strengthened as well. This is especially important to persons afflicted with hyper lordosis/hypo lordosis and posture weaknesses of the lumbar spine. The aforementioned exercise is traditionally prescribed by chiropractors to enhance strength in the lower back or "lumbar". The same could be said for the traditional leg curl. As eluded to earlier, the leg curl (hamstrings) exercise utilizing a weighted dumbbell requires assistance and attention of a spotter or a second party. If the weight should "get away", during the course of the exercise, the damage could be substantial such as spinal or neck injuries. When utilizing the instant device, susceptablity to accidents and injuries is entirely eliminated. If a problem should arise, the subject can simply release the weight and remove the device. There is no balancing, and the need to have a second individual oversee the exercise is eliminated.

Accordingly, the instant device allows the user an array of choices including a combination of aerobics and anaerobic exercises. Furthermore, the ability to utilize and conform to a very basic domestic exercise setting without the necessity of expensive additional weights or machines creates a host of applications in the field of home fitness. The device is unique in this manner as it allows the user a wider variation of choices requiring little or no other expenditures.

U.S. Pat. No. 4,949,957, (Cucchiara) makes no reference to the use or the application of the single-cuff design for the purpose of rehabilitation or the implementation of posturing and increasing strength and resilience in both limbs simultaneously.

Thus, the scope of the invention is determined by the appended claims interpreted in view of the aforementioned text.

BRIEF DESCRIPTION OF THE DRAWINGS

The accompanying drawings which form a part of the specification, illustrate preferred embodiments of the invention, and taken with the detailed description which follows, serve to explain the principals and operation of the invention.

In the Figures.

DETAILED DESCRIPTION OF THE INVENTION

Figure 1:
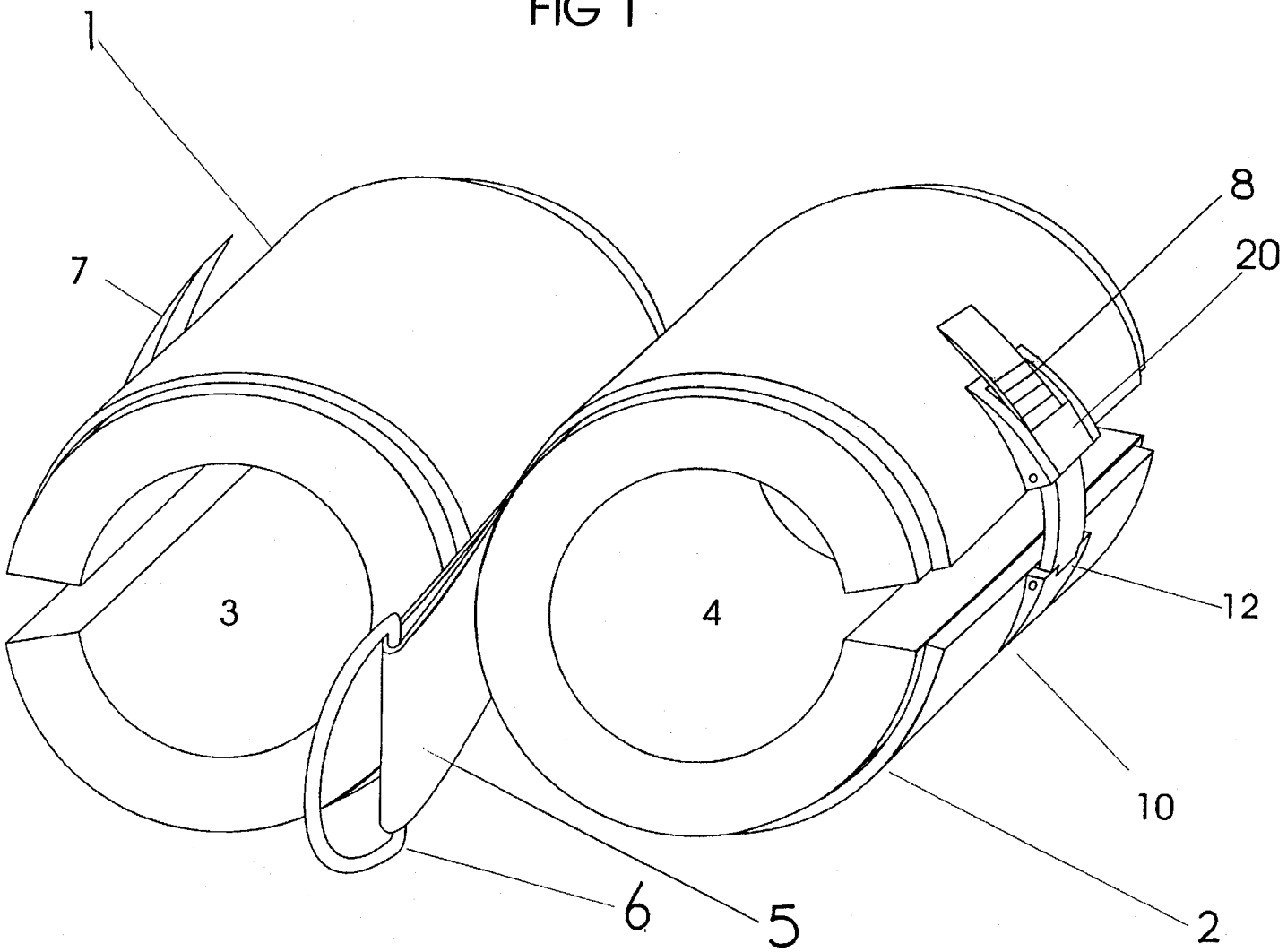
FIG. 1 is an isometric view of the weight training cuffs of the present invention.
Figure 2:
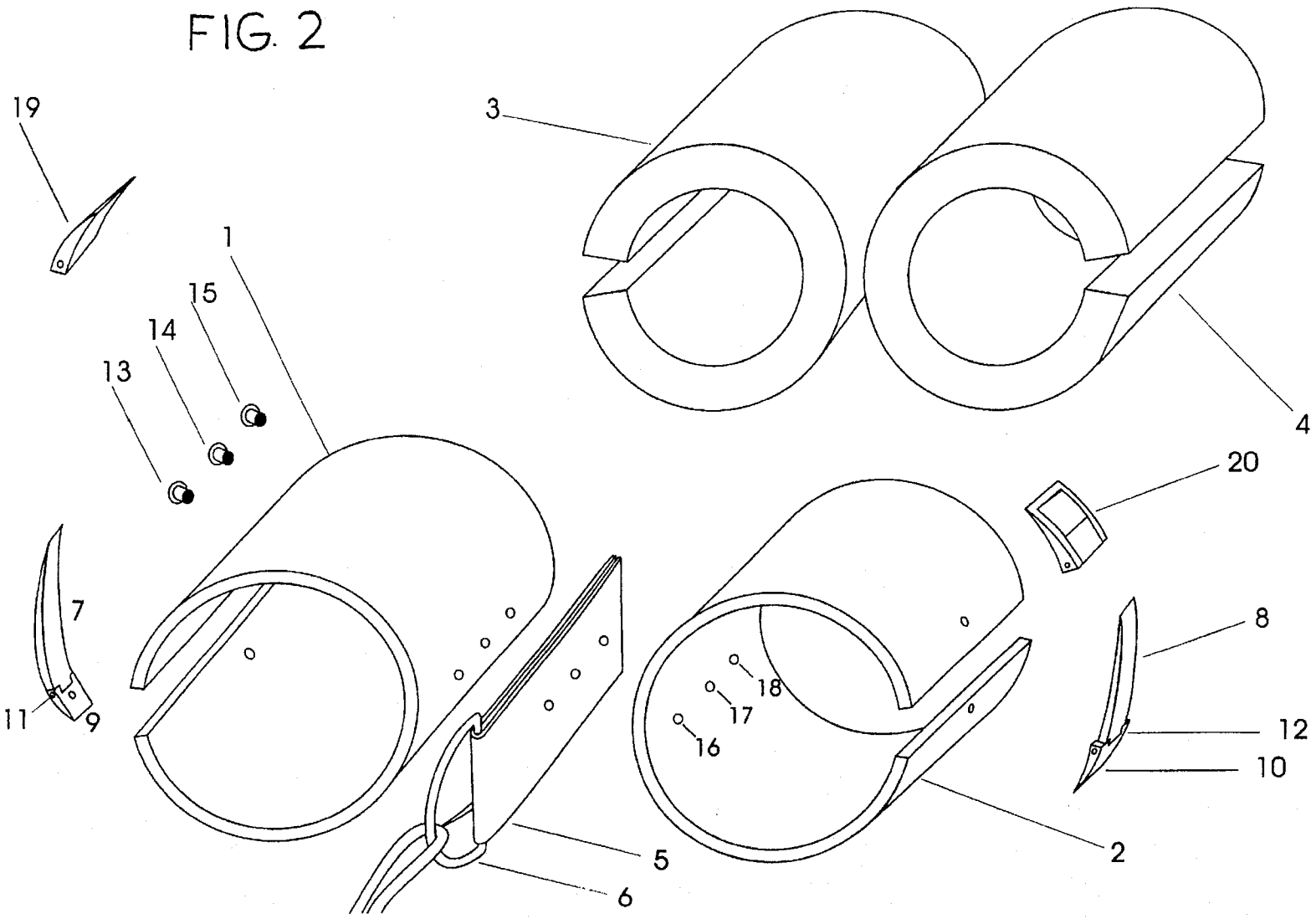
FIG. 2 is an explosive view of the weight training cuffs. The apparatus is broken down to the mechanical make-up including the means of external attachment (5,6) and points of fixation.

Referring to the figures, and particularly FIGS. 1 and 2, a preferred embodiment of the instant device is illustrated in FIG. 1. Elements 1-2 are twin identical symmetrical cylindrical spheres split longitudinally on both sides and connected together by the appropriately placed connectors (13, 14,15,16,17,18,) attaching not only the bodies of the device, but also the means (5,6) of which to attach external weights or tensile cables.

FIG. 1 illustrates the entire device without internal insulation. All internal as well as external hardware is permanently affixed to the bodies via rivets or other means of attachment. In FIG. 1, loop (5) passes through ring (6), creating the method of connection. Inserting loop (5) through ring (6), and placing loop (5) between the twin manacles (1,2), rivets (16,17,18) are then inserted through manacles (1,2) as well as loop (5) forming a permanent connection. FIG. 1 illustrates means of which the manacles (1,2) are adapted to the users appendages through the presence of the rachet locks (9,10). The locks (9,10) affixed to manacles (1,2) fixed portions are connected to pivot portions (12) through cotter pins which allow fixed portions (11) to be articulated with respect to pivot portions (12). In order to secure the manacles (1,2) to the users appendages, pivot portion (12) are received in load receptors (19,20) which are spring loaded and perform the locking function necessary for adherence. Once the twin manacles (1,2) are around the subjects appendages, the subject will place the pivot portions (12) having serrations (7,8) into the spring loaded receptors (19,20) and the subject will continue to insert the serrated tab through until the device becomes snug on the appendage(s). The desired weight will then be selected and the tensile cable (23), will then be secured to the external ring (6).

FIG. 2 depicts an exploded drawing in which the external and internal components are removed. The device consists of twin cuff spheres split longitudinally and equally on either respective side (1,2). The means of attachment (5) and (6), contains three respective holes in which permanent attachment (16,17,18) can penetrate and secure the bodies and the external means of attachment (5,6). The external means can be connected to either a tensile cable or and other means of resistance. When the cable is connected to the external ring or "external fastener" (6), the subject can execute any number of isotonic or controlled weighted exercises. The body or "cylinders" (1,2) of FIG. 2, is constructed from a pliable yet durable material allowing it to conform as well as stabilize the lower appendage(s). (1,2) contain a number of appropriately placed holes necessary in which to adapt the external hardware. The external hardware consists of external locking mechanisms whether mechanical or other (7,8, 9,10,11,12,19,20). The locking component once the apparatus is fitted upon the subjects' appendage(s) is secured by insertion of the serrated tab (7,8) through (19,20) until either ends of the respective cuffs are constricted, at this point, (9,10) are pressed down toward the base pulling (11,12) which act as articulating hinges, constricting and allowing the lock to conform to the outer portion of cuff (1,2) securing the apparatus to the subjects appendages. The internal components consist of the method of adaptation to external weighted means (5,6). The portion of nylon or flexible material (5), penetrates the ring or external means of adaptation (6), and is placed evenly lengthwise down the median of the twin cuffs. Holes or the means of joining the twin cuffs and the pliable fabric containing the external ring is placed down the length of the nylon as well as down the inside of the cuffs. The holes, are then lined up with the holes of both the nylon strip 5 as well as the two cuffs (13,14,15 of FIG. 1). The permanent attachments (16,17,18) are then inserted securing both the external hardware as well as the twin manacles. Upon completion of the above, the insulation (3,4) is then secured through the means of Velcro, this allows the subject to remove the insulation when it becomes worn or is no longer pliable, resilient or sanitary.

Figure 3:
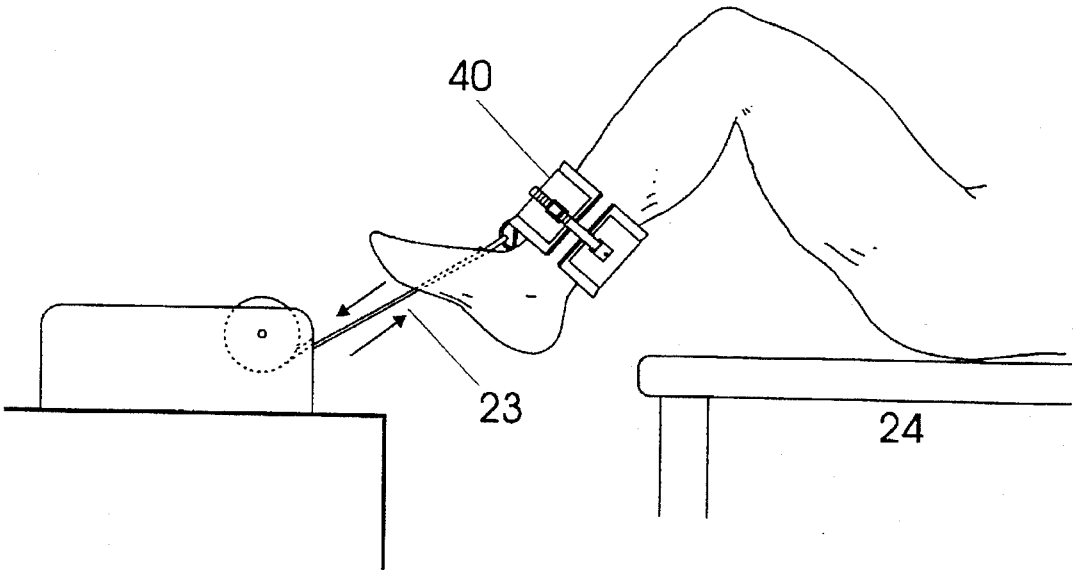
FIG. 3 shows the weight training apparatus being worn by user to facilitate muscular activity in the abdominal region while lying on a raised platform (24), allowing the legs to rise and fall causing contraction in the abdominal and surrounding musculature.

FIG.3 gives an example of the start position of a leg raise to affect a contraction in the abdominal or mid-section. The device is secured to the subject's appendages (40) and connected to the external weighted tensile cable (23) via securing the tensile cable to the external ring (6) located between the cuffs on the bottom of the apparatus. Upon selecting the appropriate weight, the subject is seated on a bench (24) or any raised means enabling the subject to percure a reclined or relaxed position, and with a upright and controlled lifting motion, raise the legs causing the contraction of the abdominal cavity and causing distal musculature response. By twisting the body in the contraction phase, the oblique as well as the serratus can be contracted these are the surrounding musculature located on the upper and lower sides of the rectus abdominal cavity.

Figure 5:
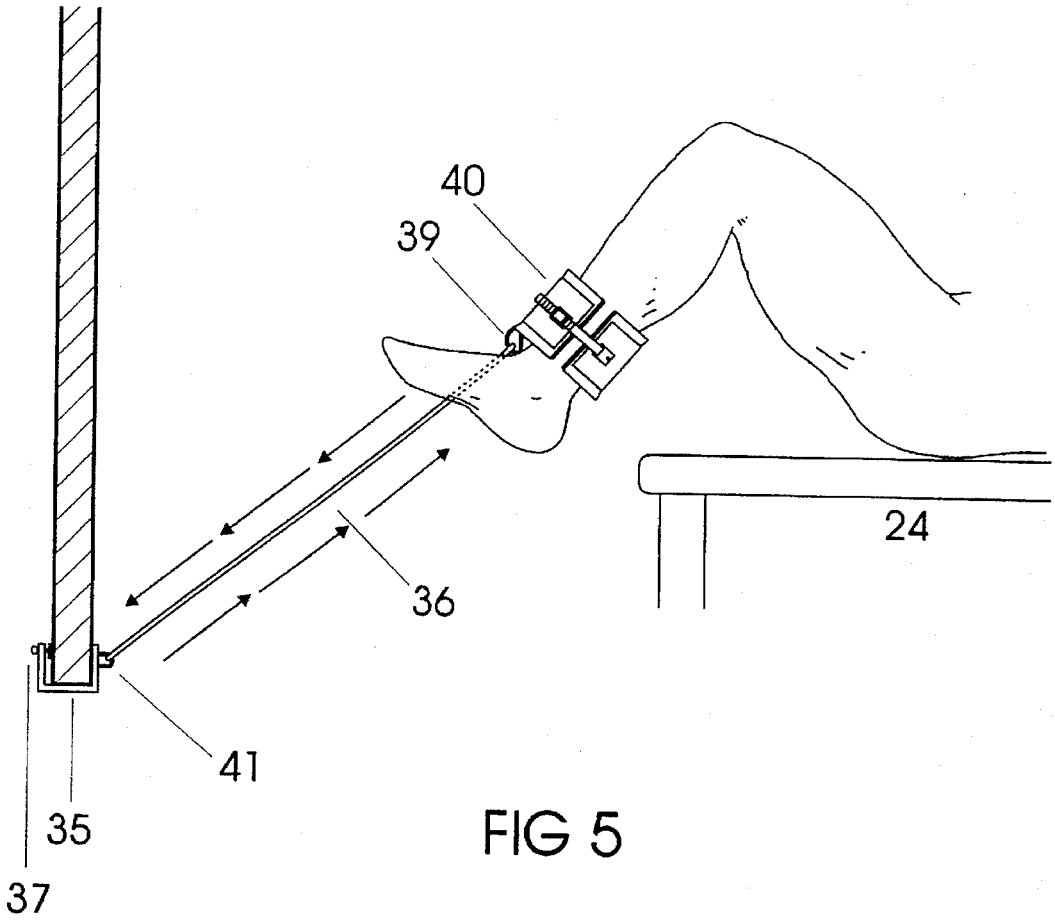
FIG. 5 illustrates the modified design performing the identical abdominal exercises as depicted in FIG. 3.
Figure 4:
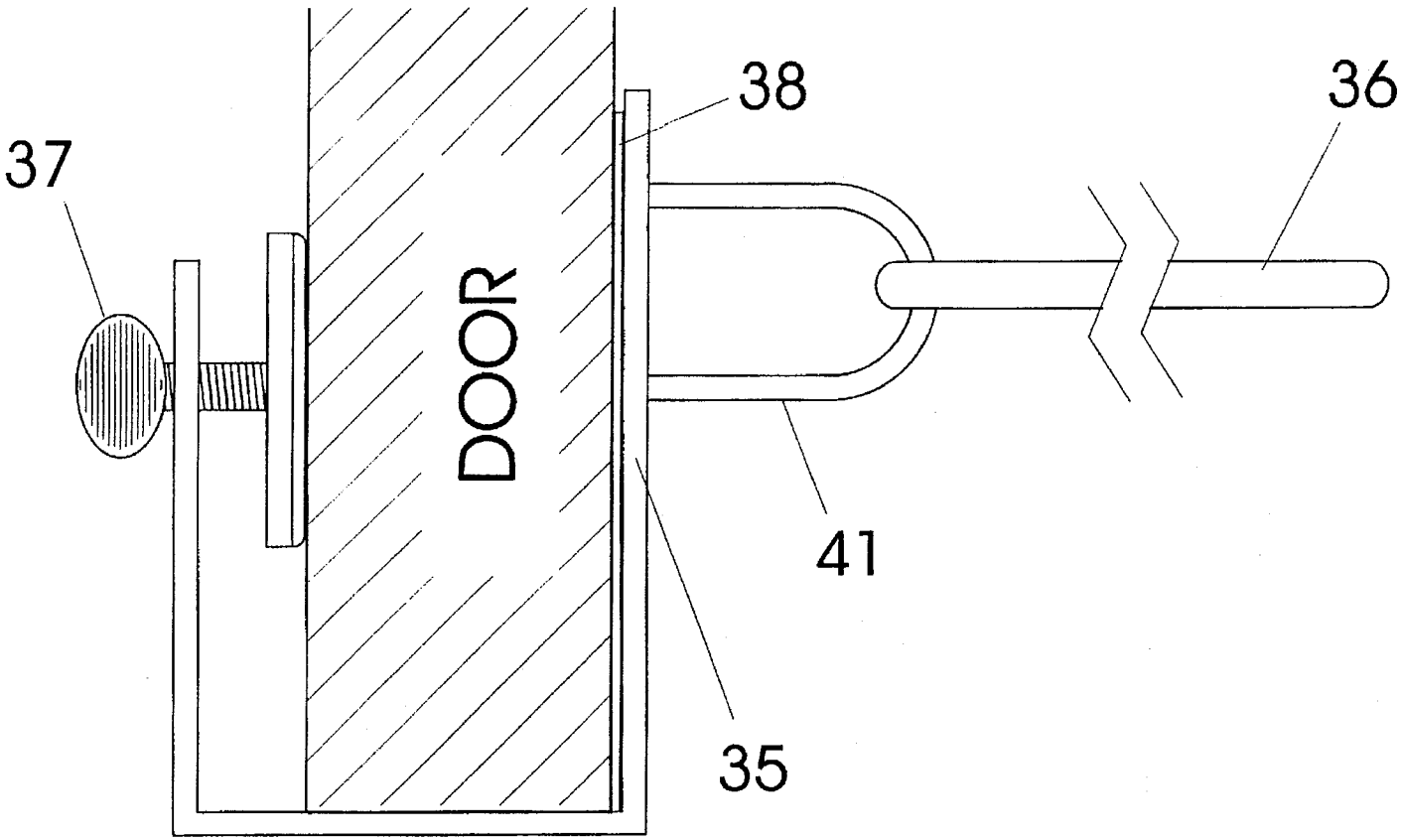
FIG. 4 illustrates a modification of the weight training cuffs for domestic use, including a securing clamp (35) for attachment to the bottom portion of the door an elastic band (36) and an attachment to the body of the device (39).
Figure 6A:
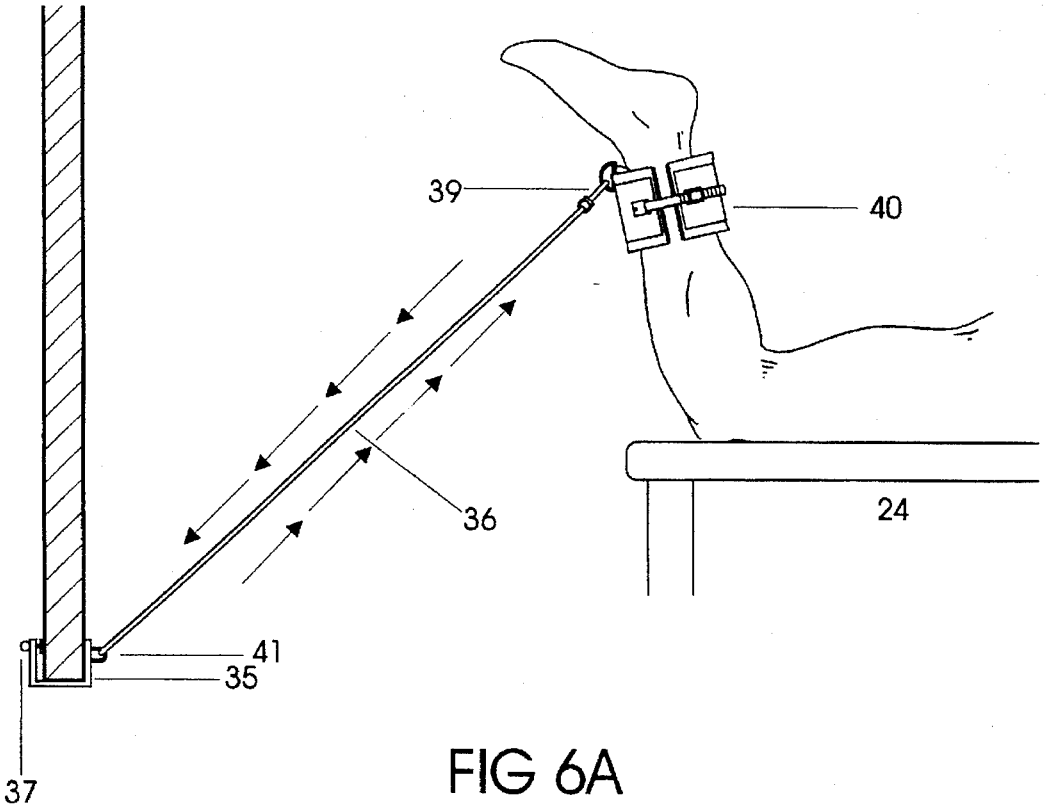
FIG. 6 illustrates a reverse or hamstring biceps curl. Laying face-down on a raised platform (24), and attaching the cuffs to both appendages as well as a tensile cable, (23) in FIG. 3, or the weighted elastic band, FIG. 6A (36). The feet are pulled in an upward motion contracting the hamstring and causing proximal muscle stimulation.
Figure 6:
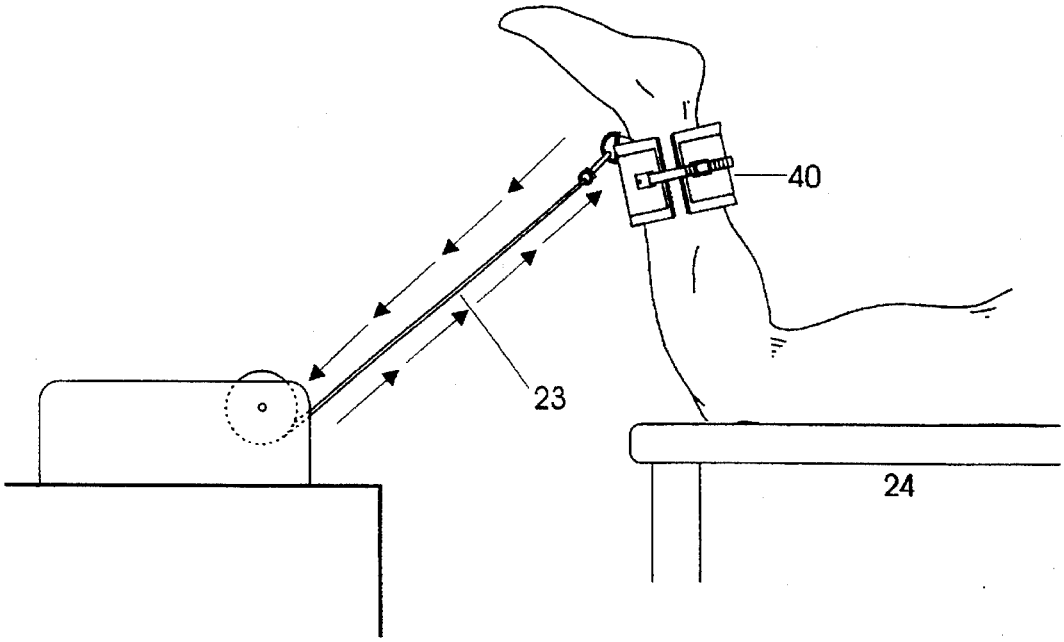

FIG. 4 illustrates the additional equipment necessary to facilitate the application of the device to a domestic non-equipped gym environment (as illustrated in FIGS. 5,6). The method of resistance (36) consists of a weighted rubber elastic band containing a single method of adaptation (39). One end of the weighted band is inserted through the external attachment (41) located on the side of (35). Once the band is inserted, it is pulled through half way until it is even on both sides. Once this occurs, the end containing the clamp (39), is looped through and pulled tautly causing a noose and securing the band to the body of the "U" shaped clamp (35). The "U" shaped clamp is then attached to the bottom of the secured door. (37) is then tightened down in a "clockwise" manner until the clamp has formed a solid connection to the door. The internal cushioning of the clamp (38) will prevent any damage to the door. Once the locking component is safely attached, the clamp (39) is connected to the body of the device at the point of affixation (FIG. 1, item 6). The device will then be attached to the subject's appendages, (FIG. 3 item 40) and the subject may commence the exercising sequence.

FIG. 5 illustrates the device being utilized to increase musculature activity within the rectus abdominal and surrounding abdominal cavity. The subject would connect the equipment found in FIG. 4, to the bottom of a properly secured door by placing the "U" (35) under the door and continue to turn (37) in a clockwise fashion until (38) the insulated material comes flush with the surface of the door or secured element. The forementioned device in FIG. 4, consists of a "U" bracket made up of a metal or sturdy and durable material. (FIG. 4 item 35), illustrates the body of the bracket which is lined with a protective material (38) which will allow application of the bracket to a stationary object such as a door without causing damage to said object. Having secured the "anchor", it is now time to attach the external means of resistance. The weighted band (36) would be placed through (41) until both ends are equal. At this point, (39) would be placed through the opposing end and pulled through forming a "noose". Placing the device on the subjects appendages (40), and connecting the "clip" (39) found on the end of the pliable weighted band (36) to the external ring (6) of the device, the subject is then ready to complete a series of isotonic abdominal exercises. The subject seated on a raised flat surface (24), will begin raising the legs in an upright fashion, until a satisfactory contraction is achieved. The ability to diversify the setting and environment in which the device may be implemented lends to it's uniqueness. The device has further been shown to accomplish an aerobic workout. Through the elimination of the weight, the subject can increase his/her pace as well as add rythymic movements. Increasing the frequency of the movements while incorporating the use of the upper body in a form of a "crunch", the heart rate will increase accordingly providing the subject a healthy alternative to an otherwise tedious and monotonous routines.

FIG. 6 illustrates the device being used to create a contraction within the posterior portion of the hamstring biceps and surrounding muscles not limited to the gracilis, adductor Magnus, semimembranosus, semitendinosus, biceps femoris, vastus lateralis, gluteus maximus and sartorius. The subject attaches the device to his/her appendages just as in completing a abdominal leg raise, but facing down rather than up upon a flat or inclined raised object (24). The device would then be connected to the subjects appendages (40) and the tensile cable (23) would be connected to the external ring (6). Upon selecting the appropriate weight, the subject would lie face-down upon the raised surface. Through the selection of an increased angle, the subject can increase resistance and effectiveness to the upper portion of the hamstring biceps. FIG. 6A illustrates a similar hamstring exercise as FIG. 6 in a domestic setting. Utilizing the equipment illustrated in FIG. 4, the resistant elastic band (36), would be attached to the "U" clamp (35) secured to the bottom of the door. The clamp located on the band (39) would then be attached to the ring (6) located between the two cuffs. The subject will then lie facedown upon a raised, flat, object and initiate pulling the legs in an upward motion and then releasing them at a slow, steady pace. By adjusting the level of the raised surface (24), the user may orchestrate numerous movements impacting the hamstring along it's length.

I claim:

1. An exercise component for developing anatomical balance between first and second limbs using a source of opposition, said exercise component comprising:

first cylindrical cuff means for circumscribing the first limb, said first cylindrical cuff means is split in a longitudinal direction;

first latch means for securing said first cylindrical cuff means with respect to the first limb;

second cylindrical cuff means for circumscribing the second limb, said second cylindrical cuff means is also split in the longitudinal direction;

second latch means for securing said second cylindrical cuff means with respect to the second limb;

attachment means for securing said first and second cylindrical cuff means to the source of opposition; and, connection means for connecting said first and said second cylindrical cuff means to each other along their lengths.

2. The exercise component according to claim 1, wherein said connection means includes a plurality of fasteners extending through aligned apertures in each of said first cylindrical cuff means, said second cylindrical cuff means and said attachment means.

3. The exercise component according to claim 2, wherein said apertures in said first cylindrical cuff means are located diametrically opposite said respective splits.

4. The exercise component according to claim 1, wherein said attachment means includes a strap folded over on itself to form a bight, and a ring received in said bight.

5. The exercise component according to claim 1, further comprising:

first insert means for cushioning the first limb in said first cylindrical cuff means; and, second insert means for cushioning the second limb in said second cylindrical cuff means.

6. The exercise component according to claim 1, wherein said latch means includes a first clasp portion and a second clasp portion on opposite sides of each said split.

* * * * *